US007243004B2

(12) United States Patent
Shah et al.

(10) Patent No.: US 7,243,004 B2
(45) Date of Patent: Jul. 10, 2007

(54) SELF-CONFIGURING CONTROLS FOR HEATING, VENTILATING AND AIR CONDITIONING SYSTEMS

(75) Inventors: Rajendra K. Shah, Indianapolis, IN (US); Jerry D. Ryan, Indianapolis, IN (US)

(73) Assignee: Carrier Corporation, Syracuse, NY (US)

( * ) Notice: Subject to any disclaimer, the term of this patent is extended or adjusted under 35 U.S.C. 154(b) by 319 days.

(21) Appl. No.: 10/752,628

(22) Filed: Jan. 7, 2004

(65) Prior Publication Data

US 2005/0149232 A1 Jul. 7, 2005

(51) Int. Cl.
*G01M 1/38* (2006.01)

(52) U.S. Cl. ..... 700/276; 700/277; 700/299; 700/300; 236/91 D; 236/91 E

(58) Field of Classification Search ..... 700/276, 700/277, 278, 299, 300; 236/47, 91 D, 91 E; 165/253, 254, 257
See application file for complete search history.

(56) References Cited

U.S. PATENT DOCUMENTS 4,645,908 A * 2/1987 Jones ..... 165/253
5,518,176 A * 5/1996 Turner et al. ..... 236/91 C
5,735,134 A * 4/1998 Liu et al. ..... 62/230
5,909,378 A * 6/1999 De Milleville ..... 700/276
5,924,486 A * 7/1999 Ehlers et al. ..... 236/46 R
6,216,956 B1 * 4/2001 Ehlers et al. ..... 236/47
6,264,111 B1 * 7/2001 Nicolson et al. ..... 236/51
6,769,482 B2 * 8/2004 Wagner et al. ..... 165/254
6,919,809 B2 * 7/2005 Blunn et al. ..... 340/632
2002/0166659 A1 * 11/2002 Wagner et al. ..... 165/254
2004/0133314 A1 * 7/2004 Ehlers et al. ..... 700/276

* cited by examiner

*Primary Examiner*—Zoila Cabrera
*Assistant Examiner*—Charles Kasenge
(74) *Attorney, Agent, or Firm*—Carlson, Gaskey & Olds

(57) ABSTRACT

A system for self-configuring complex HVAC systems has each of several units provided with a microprocessor control. The several units are each available in various optional styles, sizes, etc. The microprocessors provide information to a central control of the particular characteristic of the particular unit. Thus, when the HVAC system is initially assembled, the microprocessors associated with the individual units report these characteristics to the control. The control then determines the characteristics of each of the individual units, and accesses control strategies for the combination of individual units that are being utilized in the particular HVAC system.

19 Claims, 3 Drawing Sheets

| | EQUIPMENT UNIT EXAMPLES | FACTORY PROGRAMMED UNIT CONFIGURATION INFORMATION | IDENTIFIED FIELD INSTALLED ACCESSORIES |
|---|---|---|---|
| 1 | THERMOSTAT/USER INTERFACE (SYSTEM CONTROL) | MODEL NUMBER<br>SERIAL NUMBER | • REMOTE ROOM SENSOR |
| 2 | VARIABLE SPEED FAN COIL | MODEL NUMBER<br>SERIAL NUMBER<br>FAN COIL SIZE<br>AIR FLOW RANGE<br>PRESSURE CONSTANTS | •ELECTRIC HEATER W/ CAPACITY<br>•OUTDOOR TEMPERATURE SENSOR |
| 3 | VARIABLE SPEED HI-EFF FURNACE<br>VARIABLE SPEED MID-EFF FURNACE | MODEL NUMBER<br>SERIAL NUMBER<br>FURNACE SIZE<br>AIR FLOW RANGE<br>PRESSURE CONSTANTS | •OUTDOOR TEMPERATURE SENSOR<br>•TWINNED FURNACE |
| 4 | TWO SPEED AIR CONDITIONER (AC)<br>TWO SPEED HEAT PUMP (HP) | MODEL NUMBER<br>SERIAL NUMBER<br>TYPE (AC OR HP)<br>CAPACITY<br>LOW/HIGH CAPACITY RATIO<br>REFRIGERANT (R-22 OR R-410A) | |
| 5 | FOUR ZONE CONTROL | MODEL NUMBER<br>SERIAL NUMBER<br>ZONE RANGE (FIELD ADJUSTABLE) | •REMOTE ZONE SENSOR(S)<br>•VENTILATOR<br>•LEAVING AIR TEMPERATURE SENSOR<br>•HEAT PUMP TEMPERATURE SENSOR |
| 6 | ZONE SMART SENSOR | MODEL NUMBER<br>SERIAL NUMBER<br>ZONE NUMBER (FIELD ADJUSTABLE) | |
| 7 | INTERFACE MODULE | MODEL NUMBER<br>SERIAL NUMBER | •VENTILATOR<br>•SINGLE SPEED HP<br>•LEGACY TWO SPEED AC/HP |
| 8 | REMOTE ACCESS MODULE | MODEL NUMBER<br>SERIAL NUMBER | •WATER LEVEL SENSOR |

FIG.1B

SELF-CONFIGURING CONTROLS FOR HEATING, VENTILATING AND AIR CONDITIONING SYSTEMS

BACKGROUND OF THE INVENTION

This application relates to a heating, ventilation and air conditioning system wherein the various units report to a central control about characteristics of the units. In this way, the control is provided with information on each of the several units, and can identify a control strategy to encompass the individual characteristics of the several units, and to ensure they cooperate efficiently.

Heating, ventilation and air conditioning (HVAC) systems are becoming increasingly complex. As an example, such systems typically include an indoor unit, which may be a furnace or heater/fan coil. Also, an outdoor unit that may be an air conditioner or heat pump is provided. Most units include a thermostat. More sophisticated systems may include separate zone controls for several zones, a ventilator, a humidifier, an air cleaner, etc.

Each of the several distinct units may have several available sizes (capacities, airflow, ranges, zone ranges, etc.) As examples, furnaces typically come in several capacity ranges, as do air conditioners. Within a size, there may also be types, such as high efficiency, mid-efficiency, etc. There are several options for each of the other units such as the zone control, ventilator, humidifier, air cleaner, etc.

To provide efficient system control, an installer must configure a control to know the characteristics of the other units installed in the particular system. As an example, the particular size or capacity of the furnace may impact the control of the ventilator, humidifier, etc. This is but one example of interaction, and a worker of ordinary skill in this art would recognize that each of the units would have several levels of interaction with other units.

The method an installer uses for configuration can take several different forms. As an example, the installer may need to set switches, jumpers or software flags in a central control. Typically, such configuration must be done for several distinct units in the system. This configuration can require the installer to be highly trained in all aspects of the systems. Errors in proper configuration can result in inefficient control, including customer dissatisfaction, malfunction, inefficient operation, and even equipment failure.

As HVAC systems become even more sophisticated, and perform more advanced functions, the complexity of configuration will only increase.

SUMMARY OF THE INVENTION

A disclosed system is self-configuring, in that plural units are provided with an electronic control that reports the unit's particular characteristics to a central control. The central control takes in the characteristics of each of the several units, and has available to it optimum operational strategies based upon the combination of several units that have reported.

In disclosed embodiments of this invention, each of the main units are provided with microprocessor controls that communicate with the central control. The central control is preferably located within the thermostat.

The central control is preferably provided with control algorithms to control the inter-related operation of the several units based upon the characteristics of each unit. Thus, once the system is initially assembled, each of the several units communicates its individual characteristics to the central control. The central control is then able to control each of the units in an efficient manner based upon how the several units would be best operated in combination with the other units. The controls that are utilized once the characteristics of the units have been determined, are known. This invention extends to the way the size, type, etc. information is supplied to the central control. Problems with regard to configuration are eliminated, as the "configuration" is done at set-up.

These and other features of the present invention can be best understood from the following specification and drawings, the following of which is a brief description.

BRIEF DESCRIPTION OF THE DRAWINGS

FIG. 1B shows examples of the types of information that might be provided.

DETAILED DESCRIPTION OF THE PREFERRED EMBODIMENT

Figure 1:
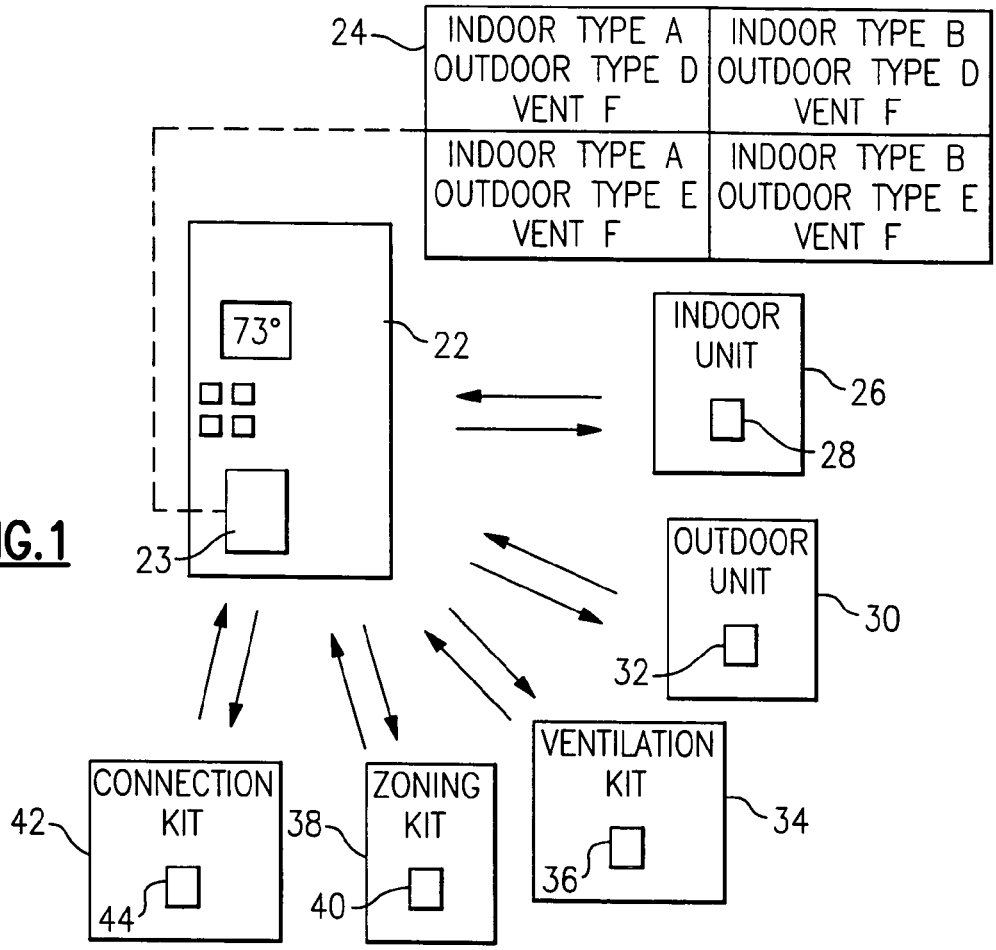
FIG. 1 is a schematic view of a building HVAC system.

FIG. 1 schematically shows an HVAC system 20 incorporating a thermostat 22. As shown, thermostat 22 incorporates a microprocessor 23 which is a central control for system 20. The microprocessor 23 has available access to a memory 24. An indoor heating unit 26 may be a furnace, or a heater and fan, and is also provided with a microprocessor 28. An outdoor unit 30 which may be an air conditioner or heat pump, is also provided with a microprocessor 32.

An auxiliary device, shown as a ventilation device 34, has its own microprocessor 36. Various zone controls 38 have microprocessors 40 shown schematically also. A connectivity kit, such as a remote access module 42 has a microprocessor 44. A remote access module is typically a wireless link to an internet connection that allows a user to monitor or change temperature conditions from a remote location. This is an example system, and this invention does extend to systems with fewer units and systems with more units.

As shown, each of the units 26, 30, 34, 38 and 42 communicate with the microprocessor 23. The microprocessors 28, 32, 36, 40 and 44 associated with the several units control operation of each individual unit. The microprocessors 28, 32, 36, 40 and 44 receive instructions from the microprocessor 23. Microprocessor 23 sends instruction to achieve temperature, etc. as requested by a user through the thermostat.

Moreover, and in accordance with this invention, the microprocessors 28, 32, 36, 40 and 44 are operable to provide characteristic information to the microprocessor 23. In particular, each of the units 26, 30, 34, 38 and 42 come in optional sizes, capacities, etc. Their individual microprocessors are able to communicate information to the microprocessor 23 at the thermostat 22 to report on the particular characteristic of the particular installed unit 26, 30, 34, 38 and 42.

Each of the microprocessors (28, 32, 36, 40 and 44) associated with the particular reporting units have stored information that is associated with a particular characteristic of the units (26, 30, 34, 38 and 42), and can distinguish between the available types of reporting units. As an example, if there are several available indoor units, the characteristic information stored in the microprocessor 28 of the indoor unit 26 would carry some code indicative of the particular characteristic. The microprocessor 23 is provided information such that the reporting information from the indoor unit 26 would let the microprocessor 23 know what the particular characteristics are.

The characteristic information is preferably programmed into each unit's microprocessor in the factory at the time the equipment is manufactured. One preferred method of factory programming the configuration information is by a factory run test computer, which can recognize the exact model being tested. The factory run test computer can then digitally download the model specific information, or the characteristic information, into the electronic control of the unit. Alternatively, some configuration information may be factory set by means of jumpers, switches, or model plugs.

When the system is initially installed, the microprocessor 23 is provided with this characteristic information on each of the units 26, 30, 34, 38 and 42. If a unit is ever changed, the replacement unit will need to report its characteristic information. Thus, the reports preferably occur at least periodically.

Figure 2:
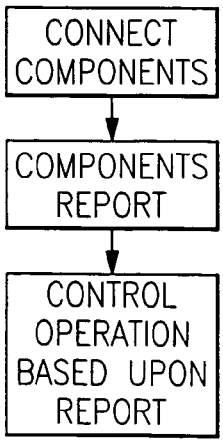
FIG. 2 is a flowchart of a method according to the present invention.

As shown in FIG. 2, an initial step in this invention, is to connect the units together. The units will then all report to the microprocessor 23. Microprocessor 23 can then access a memory 24 to determine how the several units are best controlled in combination with each other to achieve optimal results. The information in the memory 24 may be determined experimentally, or in other ways known to a worker of ordinary skill in the art. A worker of ordinary skill in the art would recognize how each of the several units are best utilized in combination with each other dependent upon the characteristic of each of the units, or how such optimal operation algorithms can be determined.

As shown for example in FIG. 1, within the memory 24 are a plurality of available options for the indoor unit, the outdoor unit, and the ventilator. Various combinations of types, shown here indicated by letters of the alphabet, are stored, and are associated with algorithms for operation of that preferred combination of type units. Once the microprocessor 23 is provided with information of the types of indoor unit, outdoor unit, and ventilation device, it can identify and utilize appropriate controls for the particular combination. The illustrated memory is an oversimplification, in that there are other units such as shown in FIG. 1 that would also have options within the memory. Examples of the types of information, and some of the example types of units are shown in FIG. 1B. Thus, and as an example, the furnace may be programmed to report information on its characteristics such as model number, serial number, furnace size, airflow range, and pressure constants. Again, while the chart does show numerous other units and types of characteristic information, the listing is meant to be exemplary and not limiting.

Figure 1C:
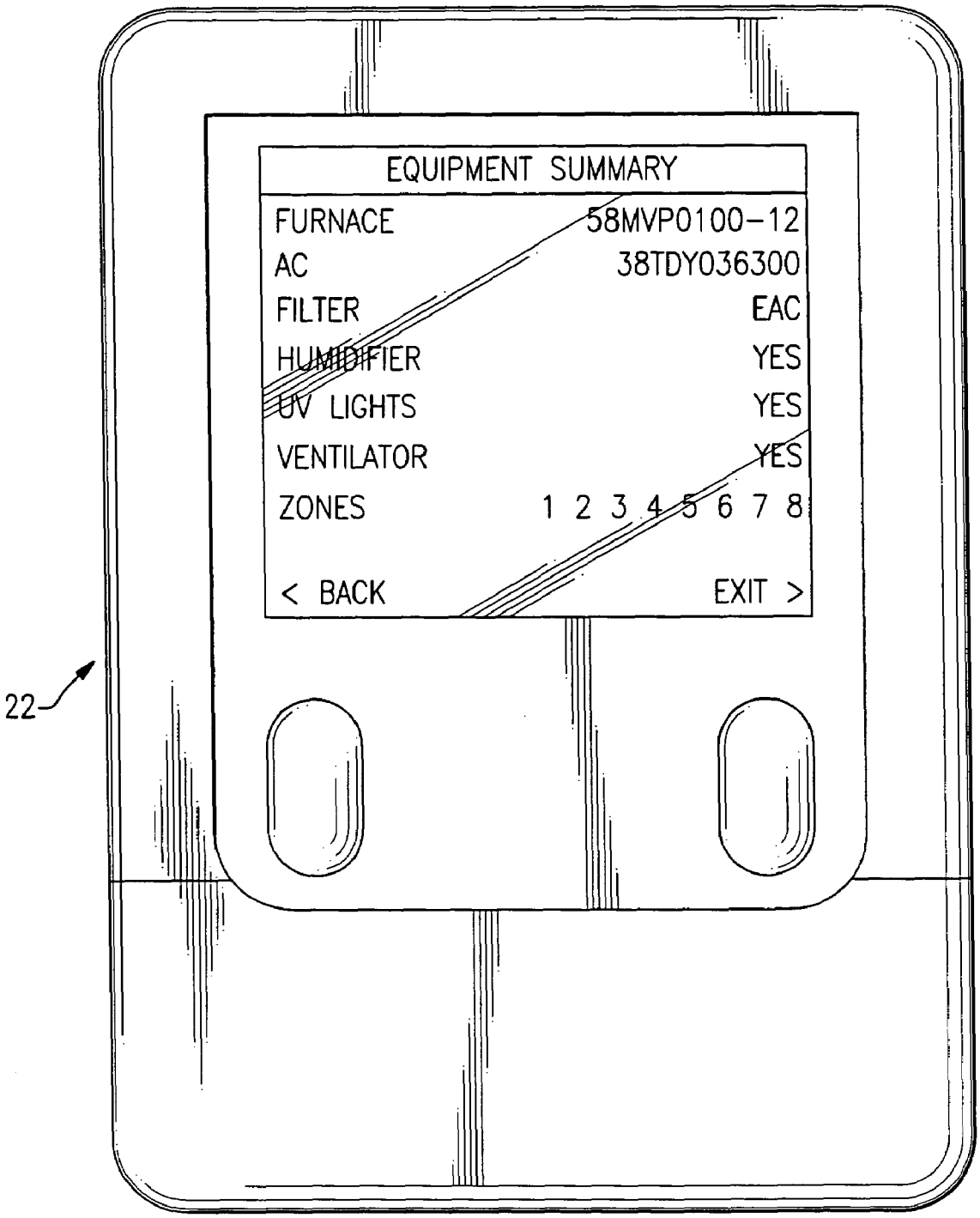
FIG. 1C shows an example display.

At the time of installation, the identified characteristics are displayed in some manner to the installer. One example display is shown in FIG. 1C. Preferably, a display on thermostat 22 would report to the installer that reporting information has been successfully received from each of the units that should have reported. The installer can then ensure proper installation, and that the characteristic information has been properly reported.

While the various units are shown reporting directly to the microprocessor 23, in practice, it will be most preferred that they would communicate through a serial bus connection such as is disclosed in co-pending U.S. patent application Ser. No. 10/752,626, entitled "Communicating HVAC System" filed on even date herewith, and naming the same inventors as this application.

Figure 3:
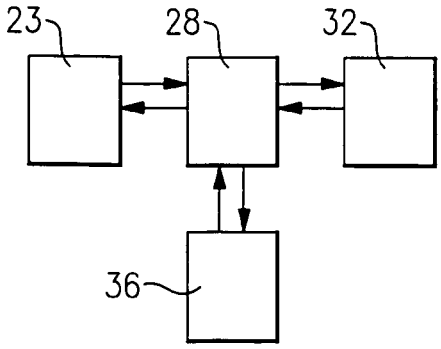
FIG. 3 shows a most preferred schematic arrangement.

As shown in FIG. 3, the preferred arrangement includes control wires providing a control communication bus between microprocessor 23 and 28. The microprocessor 32 in the outdoor unit 30 preferably communicates through indoor unit microprocessor 28 to microprocessor 23. Further, the auxiliary microprocessors such as the microprocessor 36 in the ventilation unit may also communicate to the microprocessor 23 through the indoor unit microprocessor 28. Again, this aspect of the invention is disclosed in greater detail in the above-referenced co-pending patent application, and the details of the connection are incorporated herein by reference.

As also shown in FIG. 1B, each of the reporting units may carry information from various accessing units to report to microprocessor 23. Examples are identified under "Identified Field Installed Accessories" column. One example is the capacity of an electric heater may be reported by the microprocessor 28 associated with the fan coil. The electric heater may report its capacity to microprocessor 28 such as disclosed in U.S. patent application Ser. No. 10/707,524, entitled "Identification of Electric Heater Capacity," filed on Dec. 12, 2003. The capacity of the electric heater will then be included in the characteristics communicated by microprocessor 28 to microprocessor 23. Again, other examples of accessory information are illustrated in FIG. 1B, but are not intended to be limiting.

The stored control algorithms may be as known in the art. As mentioned above, in the prior art, when the system was initially configured, an installer set flags, switches, etc. which instructed the control on which algorithm to pick. The present invention is directed to providing the information to the control without any need for the installer to perform such steps.

While microprocessor controls have been disclosed, other types of appropriate controls can be utilized to perform this invention.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A control for an HVAC system comprising:

a central control for receiving information from each of a plurality of HVAC units, said central control being operable to receive information about characteristics of the plurality of HVAC units, and to access a memory of control algorithms, at least one of said plurality of HVAC units being of the type that there are several available models, and at least one of the characteristics of said one of the plurality of HVAC units is an identification of the particular model which has been incorporated into a system receiving said central control, said memory including a plurality of control algorithms, with each of said control algorithms being associated with a particular set of combination of characteristics of the plurality of HVAC units that may report to the control, and the particular model being included in said particular set of combination of characteristics of the plurality of the HVAC units, said control selecting one of said plurality of control algorithms associated with the particular combination of characteristics of the plurality of HVAC units that report to the control, and said central control being operable to control the plurality of HVAC units using said selected one of said plurality of control algorithms.

2. The control as set forth in claim 1, wherein said central control includes a microprocessor control.

3. The control as set forth in claim 1, wherein said central control is in a thermostat.

4. The control as set forth in claim 1, wherein said information about characteristics of said plurality of reporting HVAC units comes to said central control over a single data bus.

5. The control as set forth in claim 1, wherein said characteristic information includes information on the size of said plurality of HVAC units.

6. An HVAC system comprising;

an indoor unit having a control operable to communicate characteristic information of said indoor unit to a central control, an outdoor unit having a control operable to communicate characteristic information of said outdoor unit to said central control; and said central control communicating with said indoor unit and said outdoor unit, and said central control receiving said characteristic information from said indoor unit and said outdoor unit, and determining an optimal control strategy for said indoor unit and said outdoor unit based upon said reported characteristic information, said central control storing a plurality of optimal control strategies, and selecting a particular one of said optimal control strategies to utilize based upon the particular characteristic information reported from said indoor unit and said outdoor unit; and wherein said indoor unit is one of a furnace and a heater/fan combination, and said outdoor unit is done of an air conditioner and a heat pump.

7. The system as set forth in claim 6, wherein said central control is mounted on a unit other than said indoor and outdoor units.

8. The system as set forth in claim 7, wherein said central control is mounted in a thermostat.

9. The system as set forth in claim 6, wherein said central control also receives characteristic information from auxiliary equipment.

10. The system as set forth in claim 9, wherein said central control receives characteristic information from a ventilation device.

11. The system as set forth in claim 9, wherein zoning controls provide characteristic information to said central control.

12. The system as set forth in claim 9, wherein said control receives characteristic information from a connectivity kit.

13. The system as set forth in claim 6, wherein said characteristic information from said indoor and said outdoor units comes to said central control over a single data bus.

14. The system as set forth in claim 6, wherein said characteristic information includes information on the size of a plurality of HVAC units.

15. The system as set forth in claim 6, wherein at least one auxiliary component is mounted to at least one of said indoor and outdoor units, with said control for one of said indoor and outdoor units identifying characteristics of said auxiliary component, and reports said identified characteristic of said auxiliary component to said central control.

16. The system as set forth in claim 6, wherein said particular one of said optimal control strategies is selected based upon the combination of received characteristic information from both said indoor unit and said outdoor unit.

17. An HVAC system comprising:

an indoor unit having a control operable to communicate characteristic information of said indoor unit to a central control, an outdoor unit having a control operable to communicate characteristic information of said outdoor unit to said central control;

said central control communication with said indoor unit and said outdoor unit, and said central control receiving said characteristic information from said indoor unit and said outdoor unit, and determining an optimal control strategy for said indoor unit and said outdoor unit based upon said reported characteristic information, said central control storing a plurality of optimal control strategies, and selecting a particular one of said optimal control strategies to utilize based upon the particular characteristic information reported from said indoor unit and said outdoor unit; and said central control receiving said characteristic information, and accessing a stored memory wherein various control algorithms are stored based upon particular combinations of indoor and outdoor units, and said central control utilizing said associated optimum control algorithms based upon the communicated characteristic information of said indoor and outdoor units.

18. A method of operating an HVAC system comprising the steps of:

(1) providing a plurality of units in an HVAC system including at least an indoor unit and an outdoor unit and a central control, said indoor and outdoor units having a particular set of characteristics from a plurality of available types of indoor and outdoor units;

(2) communicating stored characteristic information from said indoor and outdoor units to said central control; and (3) associating said reporting characteristic information at said central control, to identify a particular combination of said reporting indoor and outdoor units, and accessing optimum control algorithms, said memory including a plurality of control algorithms, with each of said control algorithms being associated with a particular set of combination of characteristics of the plurality of HVAC units that may report to the control, said control selecting one of said plurality of control algorithms based upon said particular combination of said indoor and outdoor units, and utilizing said selected one of said plurality of control algorithms to control the plurality of units.

19. The method as set forth in claim 18, wherein auxiliary units further provide characteristic information to said central control, and are utilized to determine optimum control algorithms at said central control.

* * * * *

UNITED STATES PATENT AND TRADEMARK OFFICE

CERTIFICATE OF CORRECTION

PATENT NO. : 7,243,004 B2
APPLICATION NO. : 10/752628
DATED : July 10, 2007
INVENTOR(S) : Shah et al.

It is certified that error appears in the above-identified patent and that said Letters Patent is hereby corrected as shown below:

Claim 17, Column 6, line 14: “communication” should read as --communicating--

Signed and Sealed this

Sixth Day of November, 2007

JON W. DUDAS
*Director of the United States Patent and Trademark Office*